US010509353B2

(12) United States Patent
Kitada

(10) Patent No.: US 10,509,353 B2
(45) Date of Patent: Dec. 17, 2019

(54) IMAGE FORMING APPARATUS AND STORAGE MEDIUM

(71) Applicant: KONICA MINOLTA, INC., Chiyoda-ku, Tokyo (JP)

(72) Inventor: Tomo Kitada, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/278,170

(22) Filed: Feb. 17, 2019

(65) Prior Publication Data

US 2019/0286034 A1 Sep. 19, 2019

(30) Foreign Application Priority Data

Mar. 14, 2018 (JP) ..... 2018-046216

(51) Int. Cl.
*G03G 15/00* (2006.01)
*G03G 15/08* (2006.01)

(52) U.S. Cl.
CPC ..... *G03G 15/5041* (2013.01); *G03G 15/0855* (2013.01); *G03G 2215/00042* (2013.01)

(58) Field of Classification Search
CPC ..... G03G 15/5041; G03G 15/0855; G03G 2215/00042
See application file for complete search history.

(56) References Cited

U.S. PATENT DOCUMENTS 4,913,991 A * 4/1990 Chiba ..... G03G 9/0821 430/111.4
2010/0111547 A1* 5/2010 Kawamoto ..... G03G 15/5062 399/30
2014/0119756 A1* 5/2014 Nakajima ..... G03G 15/5025 399/49

FOREIGN PATENT DOCUMENTS

JP 2013033167 A 2/2013

* cited by examiner

*Primary Examiner* — Joseph S Wong
(74) *Attorney, Agent, or Firm* — Holtz, Holtz & Volek PC

(57) ABSTRACT

An image forming apparatus includes an image former; a detector; and a hardware processor that: calculates a minimum area for each of the plurality of tones based on image data of the image, calculates a density ratio between the densities before and after the transferring is made for each of the plurality of tones from the densities detected by the detector, extracts as a first area a minimum area of a tone corresponding to a density ratio which switches from less than a predetermined threshold to equal to or more than the threshold, and extracts as a second area a minimum area of a tone the density ratio of which is a maximum, and changes a setting of a dot size of the image so that a size of the second area becomes the same as a size of the first area until the next setting change is performed.

7 Claims, 9 Drawing Sheets

FIG.4A

T1,T

| T1 TONE | T2 MINIMUM AREA | T3 SCREEN LINE NUMBER | T4 SOLID AREA | T5 TRANSFERRING PERFORMANCE | T6 RESOLUTION |
|---|---|---|---|---|---|
| 1 | 1 | 190 | 190 | ○ | ○ |
| 2 | 3 | 190 | 570 | × | ○ |
| 3 | 6 | 190 | 1140 | × × | ○ |
| 4 | 12 | 190 | 2280 | ○ | ○ |
| 5 | 20 | 190 | 3800 | ○ | ○ |

FIG.4B

T2,T

| T1 TONE | T2 MINIMUM AREA | T3 SCREEN LINE NUMBER | T4 SOLID AREA | T5 TRANSFERRING PERFORMANCE | T6 RESOLUTION |
|---|---|---|---|---|---|
| 1 | 2 | 95 | 190 | ○ | △○ |
| 2 | 6 | 95 | 570 | ○(△) | △○ |
| 3 | 12 | 95 | 1140 | ○ | △○ |
| 4 | 24 | 95 | 2280 | ○ | △○ |
| 5 | 40 | 95 | 3800 | ○ | △○ |

FIG.4C

T3,T

| T1 TONE | T2 MINIMUM AREA | T3 SCREEN LINE NUMBER | T4 SOLID AREA | T5 TRANSFERRING PERFORMANCE | T6 RESOLUTION |
|---|---|---|---|---|---|
| 1 | 1 | 190 | 190 | ○ | ○ |
| 2 | 12 | 47.5 | 570 | ○ | △ |
| 3 | 12 | 95 | 1140 | ○ | △○ |
| 4 | 12 | 190 | 2280 | ○ | ○ |
| 5 | 20 | 190 | 3800 | ○ | ○ |

IMAGE FORMING APPARATUS AND STORAGE MEDIUM

BACKGROUND

Technological Field

The present invention relates to an image forming apparatus and a storage medium.

Description of the Related Art

In an electrophotographic image forming apparatus, an image is fixed on a sheet by heating and pressurizing the sheet after the toner image formed on the image carrier is transferred onto the sheet.

It is known that, when such an image forming apparatus uses a sheet with unevenness machined on (such as an embossed paper) as an image forming target, the transferring performance is bad since the concave of the sheet is hard for the toner to reach at the timing of the transfer for its long distance from the toner on the image carrier.

Thus, there is suggested a technique, for example, to change the adhesion amount of the toner according to the transferring performance on the concave, in order to improve the transferring performance on the concave of the sheet (for example, refer to JP No. 2013-33167(A)).

However, the technique described in the above patent document 1 is not for practical use for aggravating the productivity by requiring a frequent image adjusting, due to the weak improvement effect of the transferring performance on the middle tone, and also the occurrence of a misalignment in the gradation.

SUMMARY

An object of the present invention is made in view of the problem shown above, and an object of the present invention is to realize a good transferring performance constantly, for a sheet having unevenness on the surface.

To achieve at least one of the abovementioned objects, according to a first aspect of the present invention, an image forming apparatus reflecting one aspect of the present invention forms an image on a sheet with unevenness on a surface, the image forming apparatus including: an image former which forms on an image carrier the image a tone of which changes gradually; a detector which detects densities of the image for a plurality of tones before and after the image is transferred onto the sheet from the image carrier; and a hardware processor that: calculates a minimum area for each of the plurality of tones based on image data of the image, calculates a density ratio between the densities before and after the transferring is made for each of the plurality of tones from the densities detected by the detector, extracts as a first area a minimum area of a tone corresponding to a density ratio which switches from less than a predetermined threshold to equal to or more than the threshold when the plurality of density ratios are seen from a lower side to a higher side of a gradation, and extracts as a second area a minimum area of a tone the density ratio of which is a maximum, and changes a setting of a dot size of the image so that a size of the second area becomes the same as a size of the first area until the next setting change is performed.

According to a second aspect of the present invention, a non-transitory computer-readable storage medium reflecting one aspect of the present invention stores a program causing a computer of an image forming apparatus to perform processes, the image forming apparatus including: an image former which forms on an image carrier an image a tone of which changes gradually; and a detector which detects densities of the image for a plurality of tones before and after the image is transferred onto a sheet from the image carrier, and forming the image on the sheet with unevenness on a surface, the processes including: calculating a minimum area for each of the plurality of tones based on image data of the image, calculating a density ratio between the densities before and after the transferring is made for each of the plurality of tones from the densities detected by the detector, extracting as a first area a minimum area of a tone corresponding to a density ratio which switches from less than a predetermined threshold to equal to or more than the threshold when the plurality of density ratios are seen from a lower side to a higher side of a gradation, and extracting as a second area a minimum area of a tone the density ratio of which is a maximum, and changing a setting of a dot size of the image so that a size of the second area becomes the same as a size of the first area until the next setting change is performed.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 4A is a figure showing an example of a data table;

FIG. 4B is a figure showing an example of a data table;

FIG. 4C is a figure showing an example of a data table;

DETAILED DESCRIPTION OF EMBODIMENTS

Hereinafter, one or more embodiments of the present invention will be described in detail with reference to the drawings. However, the scope of the invention is not limited to the disclosed embodiments.

[Configuration of the Image Forming Apparatus]

First, the configuration of an image forming apparatus in the embodiment will be described.

Figure 1:
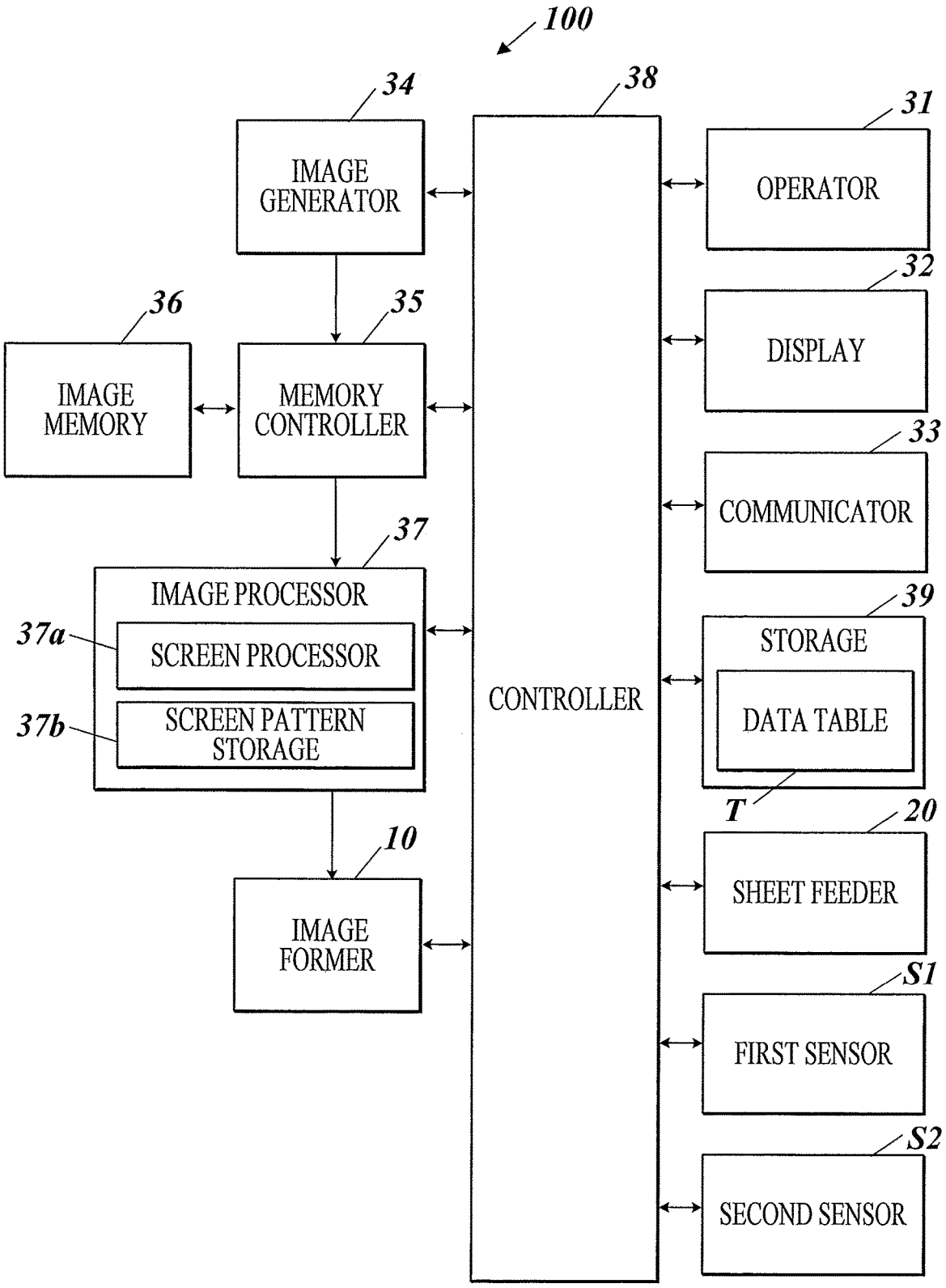
FIG. 1 is a block diagram showing the functional configuration of the image forming apparatus.

FIG. 1 is a block diagram showing the functional configuration of the image forming apparatus 100 in the embodiment.

As shown in FIG. 1, the image forming apparatus 100 includes, for example, an image former 10, first sensor (detector) S1, second sensor (detector) S2, sheet feeder 20, operator 31, display 32, communicator 33, image generator 34, memory controller 35, image memory 36, image processer 37, controller 38 and storage 39.

Figure 2:
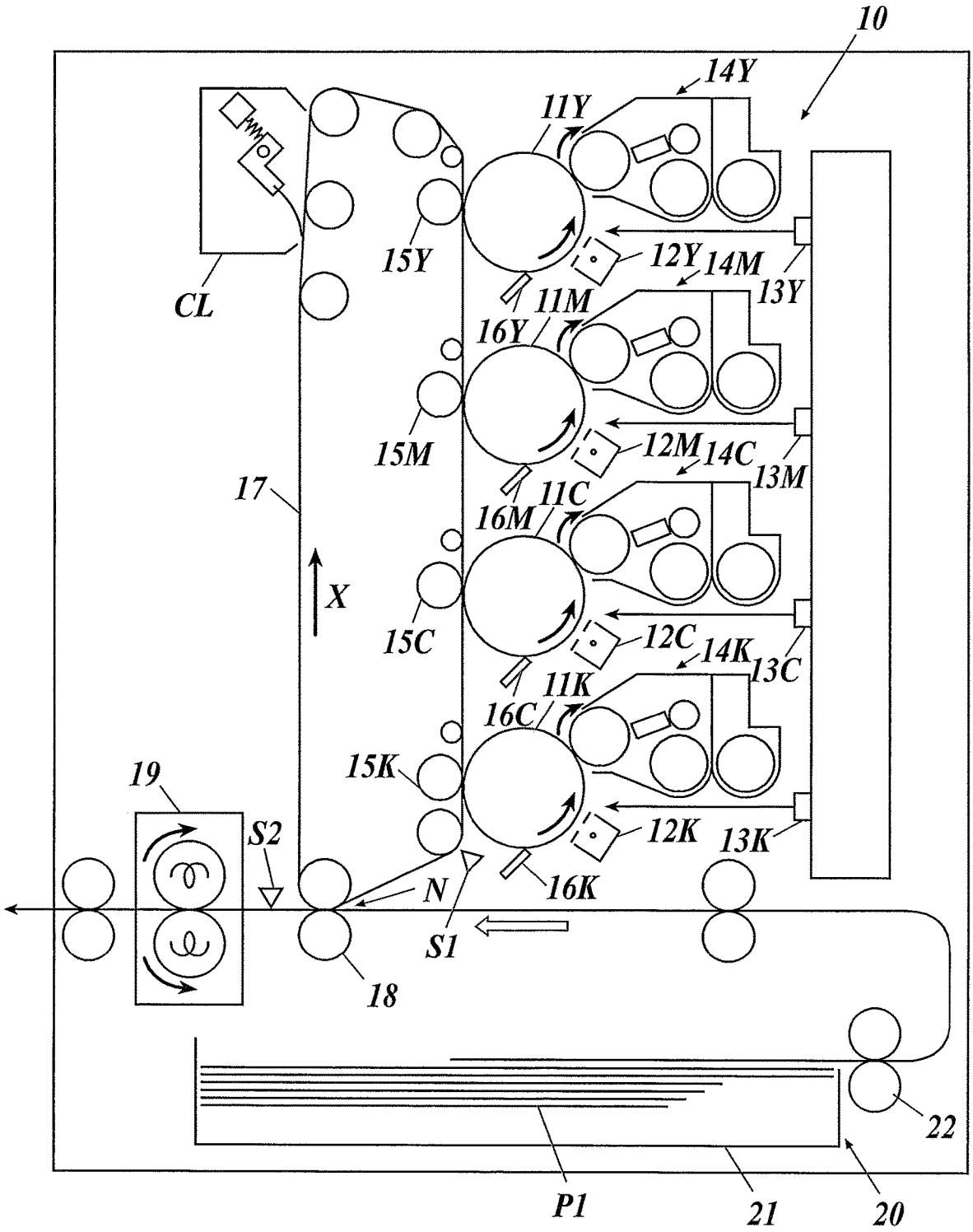
FIG. 2 is a schematic block diagram of an image former.

FIG. 2 is a schematic block diagram of an image former 10.

As shown in FIG. 2, the image former 10 includes, the photoreceptor drums 11Y, 11M, 11C, and 11K chargers 12Y, 12M, 12C, and 12K, exposers 13Y, 13M, 13C, and 13K, developers 14Y, 14M, 14C, and 14K, primary transfer rollers 15Y, 15M, 15C, and 15K, photoreceptor cleaners 16Y, 16M, 16C, and 16K, which correspond to the respective colors of yellow (Y), magenta (M), cyan (C), and black (K), intermediate transfer belt (image carrier) 17, secondary transfer roller 18, fixer 19, and belt cleaner CL.

The chargers 12Y, 12M, 12C, and 12K charge the photoreceptor drums 11Y, 11M, 11C, and 11K equally.

The exposers 13Y, 13M, 13C, and 13K are formed by a laser source, polygon mirror, lens and the like, and form an electrostatic latent image by scanning and exposer with laser beams on the surface of the photoreceptor drums 11Y, 11M, 11C, and 11K on the basis of the image data of each color.

The developers 14Y, 14M, 14C, and 14K attach the toners of each color onto the electrostatic latent image on the photoreceptor drums 11Y, 11M, 11C, and 11K, and develop.

The toner used in the developers 14Y, 14M, 14C, and 14K includes a toner particle and carrier for charging the toner particle. As the toner particle, various known toner particles can be used. There can be used the toner particle which includes a colorant, and if necessary, charge control agent, release agent, and the like in the binder resin, and which is processed with an external additive for adjusting the charging property, flow property, and the like. As the external additive agent, there can be used metal oxide of fine particles such as silica and titania, for example. As the carrier, various known carrier can be used, such as the binder-type carrier, coat-type carriers and the like. Such toner particle has an average particle size from 5 to 10 μm.

The primary transfer rollers 15Y, 15M, 15C, and 15K transfer the toner image of each color which is formed on the photoreceptor drums 11Y, 11M, 11C, and 11K onto the intermediate transfer belt 17, one by one (primary transferring). That is, a color toner image which superimposes the toner images of respective four colors is formed on the intermediate transfer belt 17.

The photoreceptor cleaners 16Y, 16M, 16C, and 16K remove the toner remaining on the surface of the photoreceptor drums 11Y, 11M, 11C, and 11K after the transfer.

The intermediate transfer belt 17 is an endless belt tensioned by a plurality of rollers (driving roller, tension roller, and driven roller), and is circumferentially driven in the direction shown by the arrow X in FIG. 2.

Further, it is sufficient that the intermediate transfer belt 17 has a desired transferring performance, and the material and thickness are not limited to the above. As the intermediate transfer belt 17, for example, an elastic intermediate transfer belt which is formed with material having elasticity at least on the surface, can be used.

The secondary transfer roller 18 transfers the toner image formed on the intermediate transfer belt 17 together onto one surface of the sheet supplied from the sheet feeder 20 (secondary transferring).

The fixer 19 fixes the toner image which was transferred onto the sheet, on the sheet by heating and pressurizing.

The belt cleaner CL cleans the intermediate transfer belt 17 which is after the transferring of the toner image onto the sheet by the secondary transfer roller 18, by removing the adhering matter such as the remaining toner, and paper powder left on the intermediate transfer belt 17 for not being transferred onto the sheet.

The first sensor S1 is a density sensor located in the position downstream of the photoreceptor drum 11K which is on the most downstream side, and upstream of the nip position of the secondary transfer roller 18, in the rotation direction of the intermediate transfer belt 17.

The first sensor S1 is, for example, a reflection type photo sensor arranged in a line along the width direction which is orthogonal to the rotation direction of the intermediate transfer belt 17, and measures the optical reflection density of the toner image which was formed on the intermediate transfer belt 17.

Further, the second sensor S2 is a density sensor located on the sheet conveyance path in the position downstream of the nip position of the secondary transfer roller 18, and upstream of the nip position of the fixer 19.

The second sensor S2 is, for example, a reflection type photo sensor arranged in a line along the width direction of the sheet conveyance path, and measures the optical reflection density of the toner image which was transferred on the sheet.

The sheet feeder 20 is provided in the lower section of the image forming apparatus 100, and includes a sheet feeding cassette 21 which can be attached and detached. The sheet contained in the sheet feeding cassette 21 is sent to the conveyance path by the sheet feeding roller 22 one by one from the upmost sheet.

In the embodiment, as a sheet, not only a plain sheet having a flat surface, but also a sheet having an unevenness on the surface (hereinafter, referred to as "embossed paper P1") is able to perform the image forming.

Returning to FIG. 1, the operator 31 includes a touch panel and the like integrally formed with the operation key and the display 32, and outputs an operation signal corresponding to these operations made to the controller 38.

The user can perform an input operation such as job setting and changing the processing content, with the operator 31.

The display 32 includes an LCD (Liquid Crystal Display) and the like, for example, and displays various screens in accordance with the instructions by the controller 38.

The communicator 33 communicates with the computer on network, for example, a user terminal, server, other image forming apparatus, and the like in accordance with the instructions by the controller 38. The communicator 33 receives data described in PDL (Page Description Language) from the user terminal, for example.

The image generator 34 performs rasterizing processing to the data described in PDL which the communicator 33 received, and generates the image data in a bitmap format which includes a tone value in each of the pixels, for each color of Y, M, C, and K. The tone value is a signal value which shows the density level of the image within the range of 0 to 100%.

Further, the image generator 34 can also include a scanner and generate the image data of each color of R (red), G (green), and B (blue) by reading the document placed by the user, with the scanner. The image generator 34 generates the image data of each of the colors C, M, Y, and K by image conversion processing the image data of each of the colors R, G, and B.

The memory controller 35 writes the image data generated by the image generator 34 into the image memory 36, and stores the image data. Further, the memory controller 35 reads out the image data from the image memory 36 and outputs it to the image processer 37.

As the image memory 36, for example, a DRAM (Dynamic RAM) and the like can be used.

The image processer 37 generates image data for image forming by performing various image processing necessary for image forming to the image data of C, M, Y, and K which was read out from the image memory 36. The generated image data is output to the image former 10 as the data for image forming.

In concrete, the image processer 37 includes a screen processer 37*a* and screen pattern storage 37*b*, and executes the screen processing which converts the pixel value of the image. Further, FIG. 1 shows the component parts of the image processer 37 which mainly function in screen processing.

The screen processer 37*a* performs screen processing to the image data under control of the controller 38, with the screen pattern SP selected among the plurality of screen patterns SP . . . stored in the screen pattern storage 37*b*.

The screen pattern storage 37*b* stores a plurality of screen patterns SP . . . .

The screen pattern SP is a matrix having a predetermined number of image spots, and the plurality of screen patterns SP . . . have different number of screen lines from each other.

The number of screen lines in the screen pattern SP is a standard which shows the accuracy of the image forming, and as the value becomes larger, the dots become smaller (the interval between the dots becomes smaller).

Figure 3A:
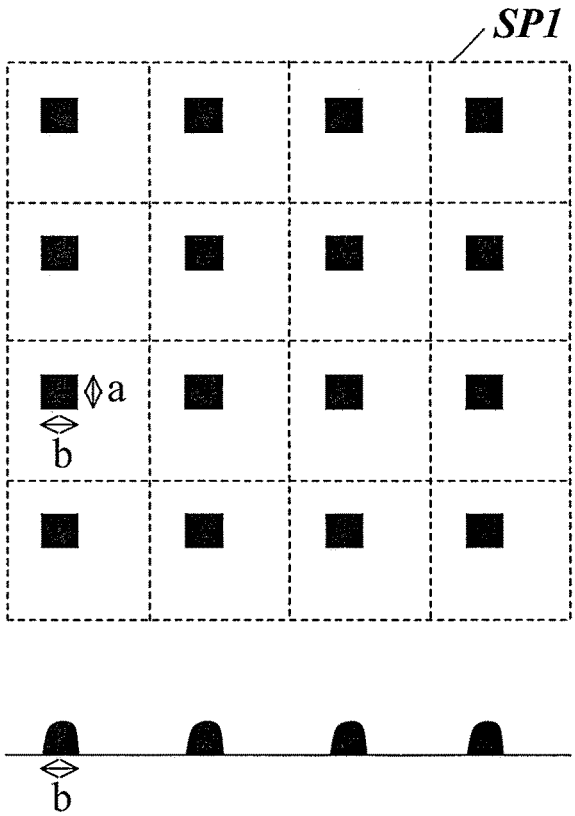
FIG. 3A is a figure showing an example of a screen pattern.
Figure 3B:
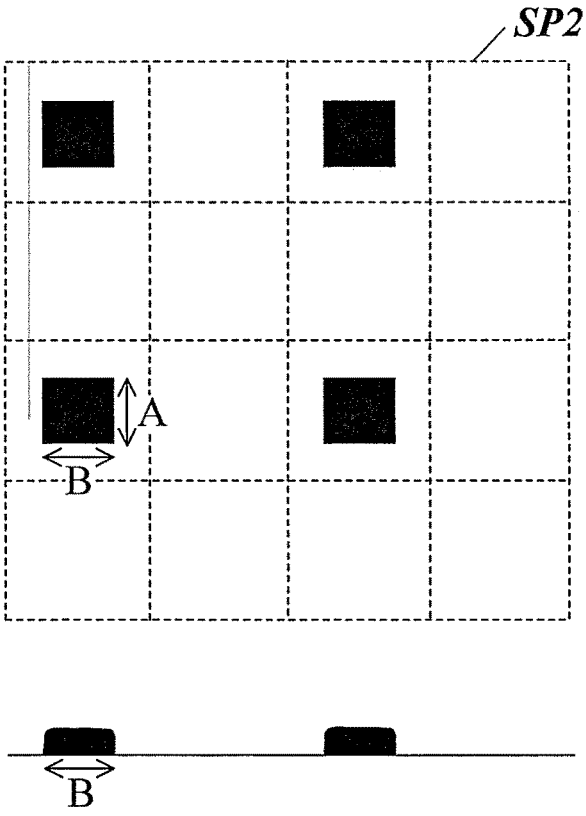
FIG. 3B is a figure showing an example of a screen pattern.

FIGS. 3A and 3B are figures showing examples of screen patterns SP stored in the screen pattern storage 37*b*. In the example, the screen pattern SP is formed of 4×4 grid (16 image spots).

FIG. 3A is a standard screen pattern SP1 which is set to be used when the normal image forming is performed, and FIG. 3B is a screen pattern SP2 which has dots smallest next to the screen pattern SP1.

The image formed by the screen pattern SP2 is coarser, since the number of the screen lines in the screen pattern SP2 is less than those of the screen pattern SP1.

All of the screen patterns SP . . . have the same toner amount inside the screen patterns SP. That is, when the toner amounts corresponding to all dots inside each of the screen patterns SP are added up, the amount is same for each of the screen patterns SP.

Therefore, for example, when the screen pattern SP2 is compared with the screen pattern SP1, in the screen pattern SP2, the distance between the dots is broader than that of the screen pattern SP1, but the vertical and horizontal sizes of each dot (A, B) is larger than the vertical and horizontal sizes of the dots (a, b) of the screen pattern SP1.

Returning to FIG. 1, the controller 38 includes CPU (Central Processing Unit), RAM (Random Access Memory) and the like. The controller 38 controls each member of the image forming apparatus 100 by reading out and performing the program stored in the storage 39.

For example, the controller 38 causes the image generator 34 to generate image data in a bitmap format, and causes the image processor 37 to perform image processing to the image data. The controller 38 forms an image on the sheet such as the embossed paper P1 by the image former 10 on the basis of the image processed image data.

The storage 39 stores a program, file, and the like which the controller 38 can read.

As the storage 39, a storage medium such as a hard disk and a ROM (Read Only Memory) can be used.

For example, the storage 39 stores a data table T used for image quality adjustment processing (later described) which is performed when an image forming is made on the embossed paper P1.

FIGS. 4A, 4B, and 4C are figures showing an example of the data table T. FIG. 4A is a data table T (T1) of the image quality adjustment processing before it is performed, and FIGS. 4B and 4C are data tables (T2, T3) of the image quality adjustment processing after it is performed.

As shown in FIGS. 4A, 4B, and 4C, the data table T has items such as tone T1, minimum area T2, screen line number T3, solid area T4, transferring performance T5, and resolution T6, for example.

The tone T1 is a number to identify the plurality of tones extracted in the image quality adjustment processing. The minimum area T2 is the minimum area of each of the tones. The screen line number T3 is the number of screen lines set for each of the tones. The solid area T4 is a value earned by multiplying the width (minimum area) with the number of screen lines, and shows the toner density of each of the tones. The transferring performance T5 shows the evaluation of the transferring performance in each of the tones with the labels of "○" "Δ" "x". The resolution T6 shows the evaluation of the coarseness of an image in each of the tones with the labels of "○" "Δ" "x".

[Operation of Image Forming Apparatus]

Next, the operation of the image forming apparatus 100 in the embodiment will be described.

In the image forming apparatus 100 of the embodiment, there is performed the image forming processing to the embossed paper P1. At this time, a transferring performance on the concave of the embossed paper P1 can be made in a good condition, by setting the screen pattern SP based on the image density difference before and after the transferring of the image onto the embossed paper P1, and performing the image quality adjustment processing which adjusts the image quality.

Figure 5:
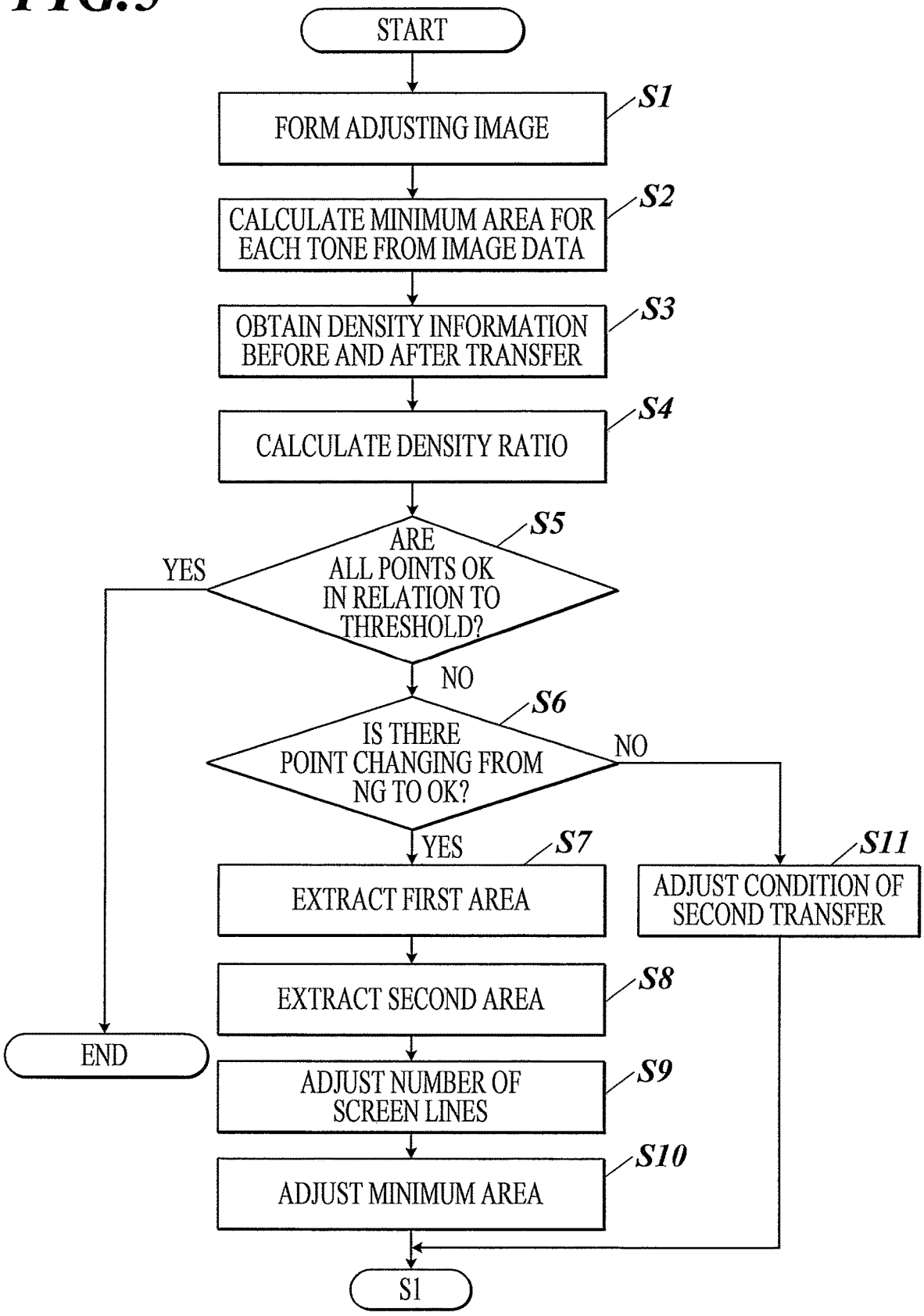
FIG. 5 is a flowchart showing an image quality adjustment processing.

FIG. 5 is a flowchart showing the image quality adjustment processing.

The image quality adjustment processing is, for example, performed before the image forming processing to the embossed paper P1 is made, by the collaboration of the controller 38 and the programs stored in the storage 39 in accordance with the execution instruction of the image quality adjustment processing made by the user.

The controller 38 forms a predetermined adjusting image 200 on the embossed paper P1 when the controller 38 receives the execution instruction for the image quality adjustment processing (STEP S1).

In concrete, the controller 38 forms the adjusting image 200 on the embossed paper P1 by controlling the image former 10 to form a toner image of the adjusting image 200 on the intermediate transfer belt 17, to transfer the toner image from the intermediate transfer belt 17 onto the embossed paper P1, and to fix the toner image onto the embossed paper P1 with the fixer 19.

Figure 6A:
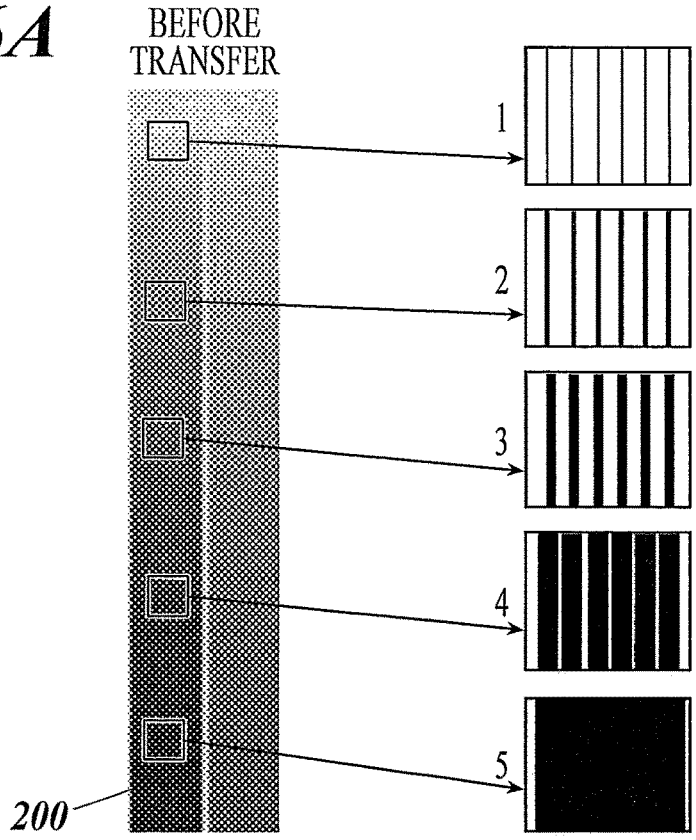
FIG. 6A is a figure showing an example of an image before the transfer.

FIG. 6A is a figure showing an example of the adjusting image 200 (the toner image on the intermediate transfer belt 17 before it is transferred onto the embossed paper P1) formed on the intermediate transfer belt 17.

As the adjusting image 200, a belt-like continuous tone pattern, which continuously changes the tone of the image signal from the lowest value to the highest value, is formed. The continuous tone pattern continuously changes the area rate of the toner for each tone.

Figure 6B:
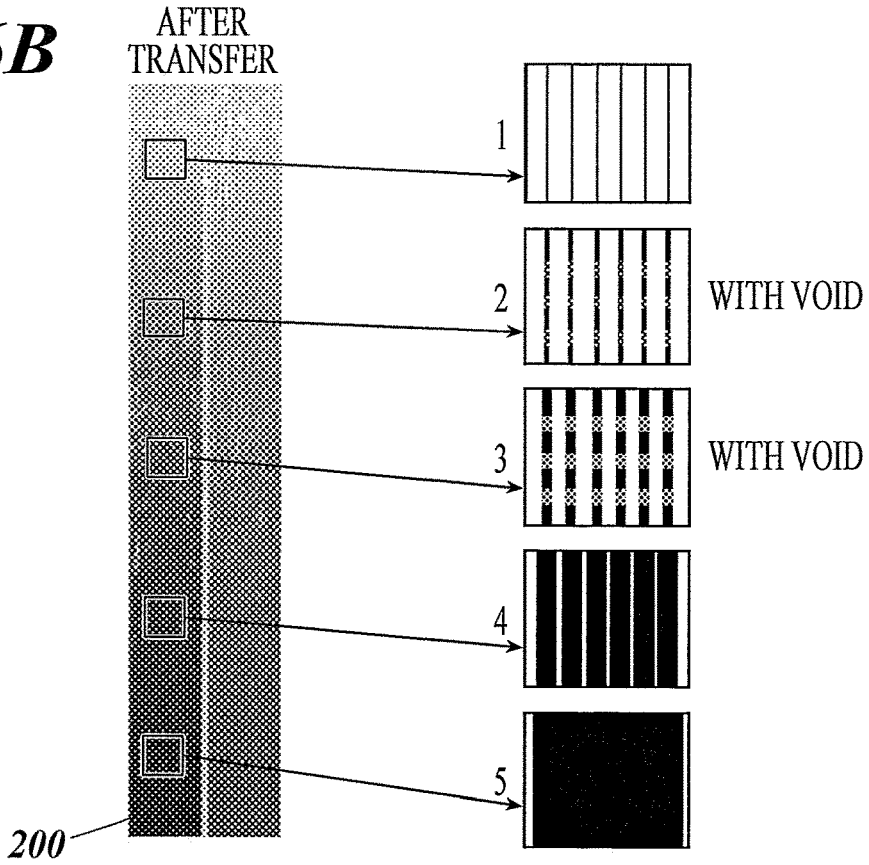
FIG. 6B is a figure showing an example of an image after the transfer.

Further, FIG. 6B is a figure showing an example of the adjusting image 200 which was transferred onto the embossed paper P1. FIG. 6B is an example of a void in the middle tone which occurred by the transferring onto the embossed paper P1.

Here, the screen pattern SP1 which is a standard among all of the tones, is used for forming the adjusting image 200. The number of screen lines in screen pattern SP1 is, for example, 190 lpi. This value is stored in the screen line number T3 of the data table T1, in advance (refer to FIG. 4A).

Next, the controller 38 extracts a plurality of points from the different tones of the adjusting image 200, and calculates the area of the minimum toner adherent region (the minimum area) in each of the extracted points (STEP S2).

In the example of FIG. 6A, the controller 38 extracts from the adjusting image 200, the five points the tones of which differs gradually. The extracted five points are each given with an identify number in order of the lower tone to the higher tone (numbers from 1 to 5).

The controller 38 than calculates the minimum area of each extracted point from the image data in each of the tones, and stores the calculated value in the minimum area T2 of the data table T1 (refer to FIG. 4A).

Each extracted point has the same size and form, however, the area rate of the toner becomes larger as the tone becomes higher. Therefore, the minimum area of tone 1 is the smallest and the minimum area of tone 5 is the largest.

At this time, the controller 38 stores the value, which shows the toner density of each extracted point, which is obtained by multiplying the minimum area by the number of screen lines, in the solid area T4 of the data table T1 (refer to FIG. 4A).

Next, the controller 38 obtains the density information of each extracted point by the first sensor S1 and the second sensor S2 (STEP S3).

This enables the first sensor S1 to acquire the image density of each extracted point of the adjusting image 200 on the intermediate transfer belt 17 before the toner image is transferred onto the embossed paper P1.

Further, the second sensor S2 acquires the image density of each extracted point of the adjusting image 200 on the embossed paper P1 after the toner image is transferred onto the embossed paper P1.

Next, the controller 38 calculates the density ratio of the image in each tone before and after the transfer, based on the acquired density information of each extracted point (STEP S4).

Next, the controller 38 determines whether the transferring performance is good or bad in every tone, by comparing the calculated density ratio with the threshold set in advance (STEP S5).

The threshold shows the transfer ratio which can be tolerated, and it can be shown as $Y \geq ax+b$ (ax: density before the transfer, y: density after the transfer, and b: constant).

Figure 7:
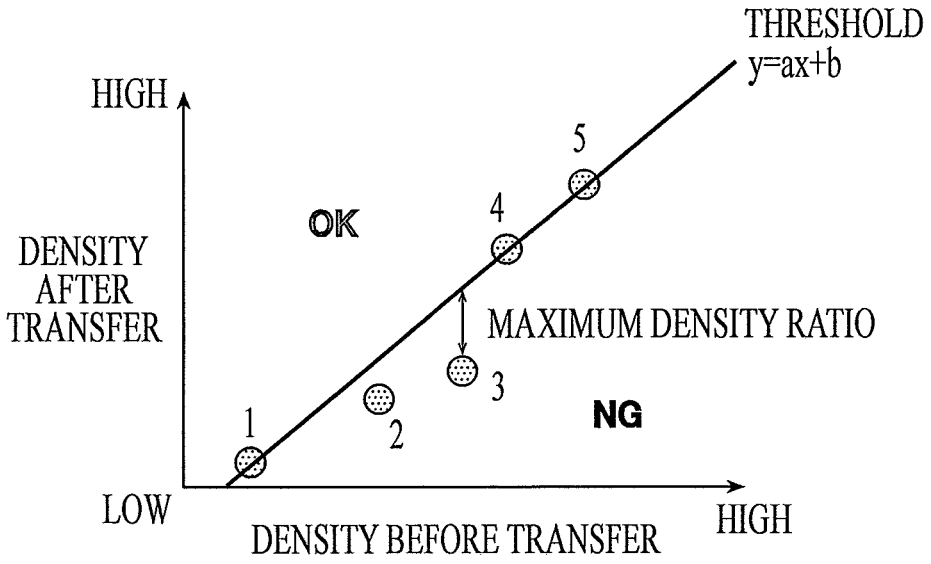
FIG. 7 is a figure showing an example of a relation between the density ratio and the threshold.

FIG. 7 is an example of a graph obtained by plotting regarding the calculated density ratio on the threshold set in advance.

In the example of FIG. 7, the transferring performance is good (OK) in tones 1, 4, and 5, but the transferring performance is not good (NG) in tones 2 and 3.

The controller 38 stores these evaluation results of the transferring performance in the transferring performance T5 of the data table T1 (refer to FIG. 4A).

The controller 38 finishes the present processing when the transferring performance is good in every tone (STEP S5: YES). That is, the image forming processing to the embossed paper P1 will start without changing the setting of the screen pattern SP.

On the other hand, when there is a tone with bad transferring performance (STEP S5: NO), the controller 38 determines whether or not there is a point which changes from less than the threshold to equal to or more than the threshold, when the calculated density ratio is seen from the lower tone to the higher tone (that is, a point changing from NG transferring performance to OK transferring performance when the tone switches from the lower tone to the higher tone) (STEP S6).

In the example of FIG. 7, the transferring performance changes from NG transferring performance to OK transferring performance at the point where the tone switches from tone 3 to tone 4.

The controller 38 refers to the data table T1 and extracts as a first area, the value of the minimum area of the tone corresponding to the density ratio which changed to OK transferring performance (STEP S7), when there is a changing point (STEP S6: YES).

In the example of FIG. 7, 12 which is the value of the minimum area in the tone 4 is extracted as the first area.

Next, the controller 38 refers to the data table T1 and extracts as a second area, the value of the minimum area of the tone which the calculated density ratio is at the maximum (STEP S8).

In the example of FIG. 7, 6 which is the value of the minimum area in the tone 3 is extracted as the second area.

Next, the controller 38 adjusts the value of the number of screen lines to make the second area to be the same area size as the first area, by the following expression (1) (STEP S9).

$$(\text{second area}/\text{first area})*\text{number of screen lines at forming an image} \quad (1)$$

In the example of FIG. 7, the number of screen lines after the adjustment is 95 lpi, from $(6/12)*190=95$.

Then the controller 38 stores the number of screen line after the adjustment in the screen line number T3 of the data table T2 (refer to FIG. 4B).

Next, the controller 38 adjusts the value of the minimum area by the following expression (2) using the values of the number of screen lines after the adjustment, so that the value of the solid area of each of the tones in the data table T1 does not change (STEP S10).

$$(\text{solid area}/\text{number of screen lines after the adjustment}) \quad (2)$$

For example, the value of the minimum area is 12 in the tone 3, from $(1140/95)=12$.

Then, the controller 38 stores the minimum area after the adjustment in the minimum area T2 of the data table T2 (refer to FIG. 4B).

Further, FIG. 4B shows an example of changing the setting of the screen line number T3 in every tone uniformly, however it is possible to change the minimum area and the number of screen lines in each tone individually, since it is sufficient to change the value of screen line number T3 in the tone which requires the improvement of the transferring performance without changing the value of the solid area.

For example, the minimum area and the number of screen lines only in the tone 2 and tone 3 can be changed, as shown in FIG. 4C.

Further, the data table T1 of the image quality adjustment processing before it is made and data tables T2 and T3 of the image quality adjustment processing after they are made are described separately for explanation, however, one data table T can be overwritten.

Next, the controller 38 returns to the above STEP S1 and repeats the following processing. That is the controller 38 returns to STEP S1 and forms the adjusting image 200 again.

At this time, a screen pattern SP (for example, screen pattern SP2) which has the number of screen lines stored in the data table T2 (or data table T3) after the adjustment is used to form an image.

Figure 8:
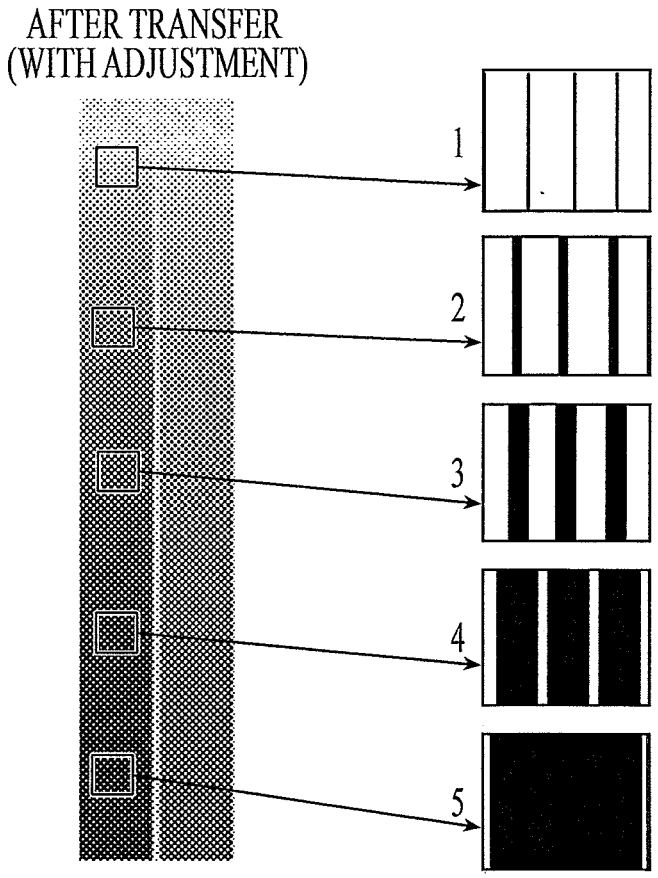
FIG. 8 is a figure showing an example of a transferred image after the adjustment.

FIG. 8 is a figure showing an example of the adjusting image 200 transferred onto the embossed paper P1 after the number of screen lines is adjusted.

In the example of FIG. 8, the minimum area of the tone 3 in the adjusting image 200 is same as that of the tone 4 of the adjusting image 200 in FIG. 6B before it is adjusted.

In the embodiment, the size (area) of the screen dot in the tone with a bad transferring performance is made larger by changing the setting of the screen pattern SP (number of screen lines) in such way.

In such way, the applied electric field becomes larger as the size of the toner clod becomes larger, which results in a good transferring performance for the improvement of the flying property of the toner.

Figure 9:
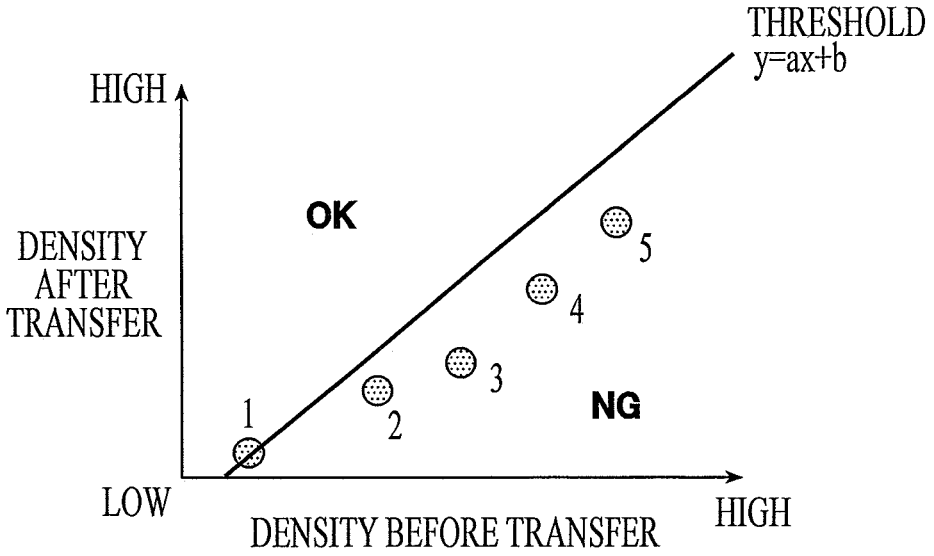
FIG. 9 is a figure showing another example of the relation between the density ratio and the threshold.

Further, in the above STEP S6, the controller 38 determines that there is a transferring failure occurring in the solid image, adjusts the electric current value of the second transfer (STEP S11), and moves onto the above STEP S1 when there is no point where the calculated density ratio changes from less than the threshold to equal to or more than the threshold when it is seen from the lower tone to the higher tone (that is, the point where it changes from NG transferring performance to OK transferring performance when it switches from the lower tone to the higher tone) (for example, refer to FIG. 9)(STEP S6: NO).

Here, as an adjustment method, there can be taken a method such as to make a table in advance by the density ratio for each of the tones. Further, it may be a method which uses a close setting value of the close sheet information of a paper profile and the like.

Further, instead of adjusting the electric current value of the second transfer, it is sufficient to take a method of changing (strengthening) the pressure of the second transfer.

Further, it is possible to obtain more certain improvement effect of the transferring performance at the timing of extracting the first area in the above STEP S7, for a coarser screen being selected by choosing the larger value (the tone with the highest density before the transfer) as the first area, when the value of the density ratio is swinging crossing over the threshold (for example, refer to FIG. 10), that is, when the switching points from NG to OK are occurring for a plurality of times.

Figure 10:
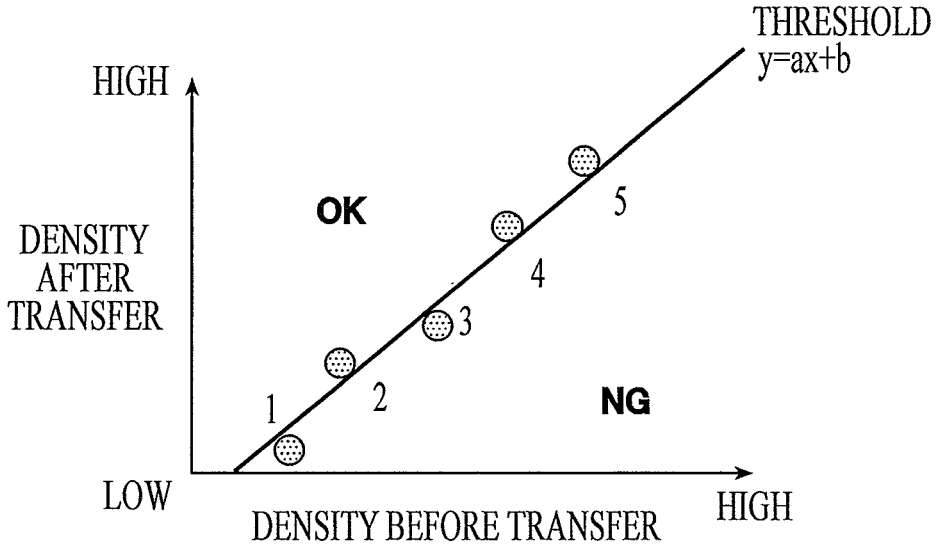
FIG. 10 is a figure showing another example of the relation between the density ratio and the threshold.

In the example of FIG. 10, the minimum area of the tone 4 will be extracted as the first area.

Further, it is preferable to make the threshold with a configuration which the setting of the threshold is changeable by the user operation to the operator 31, in consideration of the requests from the users that they do not want to drop the resolution, since the image might get coarse for the drop of the resolution by changing the setting of the screen pattern SP.

Figure 11:
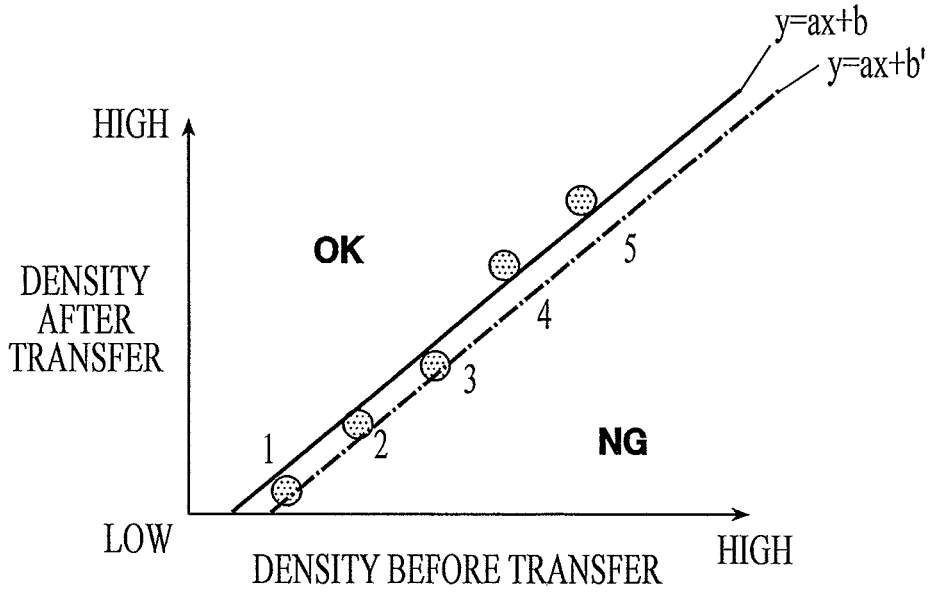
FIG. 11 is a figure showing another example of the relation between the density ratio and the threshold.

Specifically, the configuration is to drop the value of b in the threshold ($y \geq ax+b$) and make the threshold $y \geq ax+b'$, as shown in FIG. 11.

Here, the value of b is set by taking the transfer ratio and the like into consideration. It is possible to control the switching of the number of screen lines by dropping the value since the range of OK is extended.

For example, it is sufficient to make the threshold in a configuration which the controller 38 can change the setting of the threshold by providing an operation button such as resolution prior and making the user to make an operation to the operation button. In such way, it is possible to come close to the image quality which the user requests.

[Technical Effect of the Embodiment]

As described above, according to the embodiment, the image forming apparatus 100 which forms an image on the embossed paper P1 includes: an image former 10 which forms on the intermediate transfer belt 17 the adjusting image 200 a tone of which changes gradually; a detector which detects densities of the adjusting image 200 for a plurality of tones before and after the image is transferred onto the embossed paper P1 from the intermediate transfer belt 17; and the controller 38 that: calculates a minimum area for each of the plurality of tones based on image data of the adjusting image 200, calculates a density ratio between the densities before and after the transferring is made for each of the plurality of tones from the detected densities, extracts as a first area a minimum area of a tone corresponding to a density ratio which switches from less than a predetermined threshold to equal to or more than the threshold when the plurality of density ratios are seen from a lower side to a higher side of a gradation, and extracts as a second area a minimum area of a tone the density ratio of which is the maximum, and changes a setting of a dot size of the adjusting image 200 so that a size of the second area becomes the same as a size of the first area until the next setting change is performed.

Therefore, the transferring performance can be improved by the size of the screen dots in the tone with a bad transferring performance being changed according to the tone with a good transferring performance. In such way, it is possible to realize a good transferring performance regularly on the embossed paper P1.

Further, in the embodiment, in a case where there are a plurality of density ratios which switch from less than the predetermined threshold to equal to or more than the threshold when the plurality of density ratios are seen from the lower side to the higher side of the gradation, the controller 38 extracts as the first area the minimum area of the tone for which the density before the transferring is highest among the plurality of tones which correspond to the density ratios.

Therefore, it is possible to obtain much certain improvement effect on the transferring performance.

Further, in the embodiment, in a case where there is no density ratio which switches from less than the predetermined threshold to equal to or more than the threshold when the plurality of density ratios are seen from the lower side to the higher side of the gradation, the controller 38 adjusts a transferring condition of transferring the adjusting image 200 on the intermediate transfer belt 17 onto the embossed paper P1.

Therefore, the transferring performance can be improved by adjusting the transferring condition of transferring onto the embossed paper P1.

Further, in the embodiment, there are included a first sensor which reads the density of the adjusting image 200 on the intermediate transfer belt 17 before the image is transferred onto the embossed paper P1 and a second sensor which reads the density of the adjusting image 200 on the embossed paper P1 after the image is transferred onto the embossed paper P1.

Therefore, the density ratio may be obtained by comparing the image density of the intermediate transfer belt 17 before the transfer and the image density of the embossed paper P1 after the transfer.

Further, in the embodiment, there is included an operator 31 which the user operates to set the threshold.

Therefore, image forming processing which meets the demand of the user is possible.

The embodiment to which the present invention can be applied is not limited to the above-mentioned embodiments, and modifications can be made as needed within the scope of the present invention.

For example, the second sensor S2 can be located on the sheet conveyance path in the position downstream of the nip position of the fixer 19.

Further, besides the first sensor S1 and the second sensor S2, the third density sensor can be located on the sheet conveyance path in the position downstream of the nip position of the fixer 19 and read the density difference before and after the fixing. In such configuration, it is possible to detect the fixing failure (such as the detachment due to the lack of temperature) and to feedback on the temperature condition.

Further, the second sensor S2 can be located on the intermediate transfer belt 17 between the nipper of the second transfer roller 18 and the belt cleaner CL.

In such case, the density which the second sensor S2 detects is the density of the remaining toner (remaining image) on the intermediate transfer belt 17 after the image is transferred onto the embossed paper P1 and the image density after the transfer can be found by calculating the density.

Figure 12:
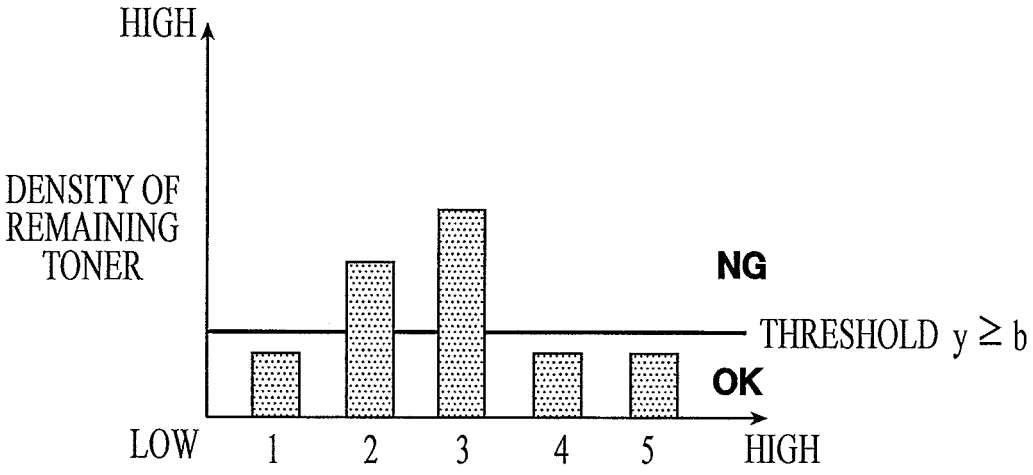
FIG. 12 is a figure to describe another method of an image quality adjustment processing.

Further, the density which the second sensor S2 detects is the density of the remaining toner on the intermediate transfer belt 17, and in a case where the transferring failure occurs in the concave of the embossed paper P1, the selection of the first area and the second area can be made by determining whether the density of the remaining toner is OK or NG by comparing the density with the predetermined threshold ($y \geq b$) which takes the measuring points lining up in order of the tones in the horizontal axis, and the remaining toner densities in the vertical axis as shown in FIG. 12, by making use of the increased amount of the remaining toner. Further, the density sensor before the transfer may not be included since the determination can be made by the coordination with the original image data.

Further, in the above embodiment, an image forming apparatus which forms (first transfers) the adjusting image 200 on the intermediate transfer belt 17 which is an image carrier, and second transfers the adjusting image 200 onto the embossed paper P1 is illustrated and described, however, the image forming apparatus may form the adjusting image 200 onto the photoreceptor drum 11 which is an image carrier, without using the intermediate transfer belt 17 and transfer the adjusting image 200 onto the embossed paper P1 from the photoreceptor drum 11. In such case, the detector is provided on the photoreceptor drum 11.

Further, in the above embodiment, the predetermined adjusting image 200 is used in the image quality adjustment processing; however, a general image besides the adjusting image 200 can be used for the image quality adjustment processing.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese patent Application No. 2018-046216, filed on 14 Mar. 2018, is incorporated herein by reference in its entirety.

What is claimed is:

1. An image forming apparatus which forms an image on a sheet with unevenness on a surface, the image forming apparatus comprising:

an image former which forms on an image carrier the image a tone of which changes gradually;

a detector which detects densities of the image for a plurality of tones before and after the image is transferred onto the sheet from the image carrier; and a hardware processor that:

calculates a minimum area for each of the plurality of tones based on image data of the image, calculates a density ratio between the densities before and after the transferring is made for each of the plurality of tones from the densities detected by the detector, extracts as a first area a minimum area of a tone corresponding to a density ratio which switches from less than a predetermined threshold to equal to or more than the threshold when the plurality of density ratios are seen from a lower side to a higher side of a gradation, and extracts as a second area a minimum area of a tone the density ratio of which is a maximum, and changes a setting of a dot size of the image so that a size of the second area becomes the same as a size of the first area until the next setting change is performed.

2. The image forming apparatus according to claim 1, wherein in a case where there are a plurality of density ratios which switch from less than the predetermined threshold to equal to or more than the threshold when the plurality of density ratios are seen from the lower side to the higher side of the gradation, the hardware processor extracts as the first area the minimum area of the tone for which the density before the transferring is highest among the plurality of tones which correspond to the density ratios.

3. The image forming apparatus according to claim 1, wherein in a case where there is no density ratio which switches from less than the predetermined threshold to equal to or more than the threshold when the plurality of density ratios are seen from the lower side to the higher side of the gradation, the hardware processor adjusts a transferring condition of transferring the image on the image carrier onto the sheet.

4. The image forming apparatus according to claim 1, wherein the detector includes a first sensor which reads the density of the image on the image carrier before the image is transferred onto the sheet and a second sensor which reads the density of the image on the sheet after the image is transferred onto the sheet.

5. The image forming apparatus according to claim 1, wherein the detector includes a first sensor which reads the density of the image on the image carrier before the image is transferred onto the sheet and a second sensor which reads the density of a remaining image on the image carrier after the image is transferred onto the sheet.

6. The image forming apparatus according to claim 1, comprising an operator which the user operates to set the predetermined threshold.

7. A non-transitory computer-readable storage medium storing a program causing a computer of an image forming apparatus to perform processes, the image forming apparatus including: an image former which forms on an image carrier an image a tone of which changes gradually; and a detector which detects densities of the image for a plurality of tones before and after the image is transferred onto a sheet from the image carrier, and forming the image on the sheet with unevenness on a surface, the processes comprising:

calculating a minimum area for each of the plurality of tones based on image data of the image, calculating a density ratio between the densities before and after the transferring is made for each of the plurality of tones from the densities detected by the detector, extracting as a first area a minimum area of a tone corresponding to a density ratio which switches from less than a predetermined threshold to equal to or more than the threshold when the plurality of density ratios are seen from a lower side to a higher side of a gradation, and extracting as a second area a minimum area of a tone the density ratio of which is a maximum, and changing a setting of a dot size of the image so that a size of the second area becomes the same as a size of the first area until the next setting change is performed.

* * * * *